United States Patent [19]

Klimpel et al.

[11] Patent Number: 4,676,890

[45] Date of Patent: Jun. 30, 1987

[54] COLLECTOR COMPOSITIONS FOR THE FROTH FLOTATION OF MINERAL VALUES

[75] Inventors: Richard R. Klimpel; Robert D. Hansen, both of Midland, Mich.

[73] Assignee: The Dow Chemical Company, Midland, Mich.

[21] Appl. No.: 856,512

[22] Filed: Apr. 28, 1986

Related U.S. Application Data

[63] Continuation-in-part of Ser. No. 802,882, Nov. 29, 1985, abandoned.

[51] Int. Cl.[4] ..... B03D 1/02

[52] U.S. Cl. ..... 209/166; 252/61; 558/232; 558/252; 558/253; 558/256; 564/501

[58] Field of Search ..... 252/61; 209/166, 167; 558/232, 252, 253, 256; 564/501

[56] References Cited

U.S. PATENT DOCUMENTS

| | | | |
|---|---|---|---|
| 1,774,183 | 8/1930 | Moses et al. | 209/166 |
| 2,169,313 | 8/1939 | Williams et al. | 209/166 |
| 2,769,839 | 11/1956 | Fincke | 564/501 |
| 3,328,442 | 6/1967 | Foye et al. | 564/501 |
| 3,397,238 | 8/1968 | Hobbs | 564/508 |
| 4,066,681 | 1/1978 | Wachter | 558/232 |
| 4,086,273 | 4/1978 | Berazosky et al. | 564/501 |
| 4,326,067 | 4/1982 | Fazio | 548/347 |
| 4,526,696 | 7/1985 | Delourme et al. | 252/61 |

*Primary Examiner*—Robert A. Wax

[57] ABSTRACT

A collector composition useful for the recovery of metal values from metal ores in a froth flotation process comprises two collectors. One collector is an organic compound containing at least 4 carbon atoms and one or more monosulfide units, wherein the carbon atoms to which the sulfur atoms are bound are aliphatic or cycloaliphatic carbons. The other collector is preferably an omega-(hydrocarbylthio)alkylamine, S-(omega-aminoalkyl)hydrocarbyl thioate, N-(hydrocarbyl)-alpha, omega-alkanediamine, N-(omega-aminoalkyl)hydrocarbon amide, omega-(hydrocarbyloxy)alkalamine, omega-aminoalkyl hydrocarbonate or mixture thereof. The collector composition floats a broad range of metal values including sulfide ores, oxide ores and precious metals.

23 Claims, No Drawings

COLLECTOR COMPOSITIONS FOR THE FROTH FLOTATION OF MINERAL VALUES

CROSS-REFERENCE TO RELATED APPLICATION

This application is a continuation-in-part of copending application Ser. No. 802,882 filed Nov. 29, 1985, now abandoned.

BACKGROUND OF THE INVENTION

This invention relates to novel collector compositions useful for the recovery of metal-containing minerals from mineral ores by froth flotation.

Flotation is a process of treating a mixture of finely divided mineral solids, e.g., a pulverulent ore, suspended in a liquid whereby a portion of such solids is separated from other finely divided mineral solids, e.g., clays and other like materials, present in the ore by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes the selective adherence of some gas to certain suspended solids and not to others and makes the particles having the gas thus adhered thereto lighter than the liquid. Accordingly, these particles rise to the top of the liquid to form a froth.

Various flotation agents have been admixed with the suspension to improve the frothing and collection process. These agents are classed according to the function to be performed and include collectors such as xanthates, thionocarbamates and the like; frothers which facilitate the forming of a stable froth such as natural oils, e.g., pine oil and eucalyptus oil; modifiers such as activators, e.g., copper sulfate, to induce flotation in the presence of a collector; depressants, e.g., sodium cyanide, which tend to prevent a collector from functioning as such on a mineral which it is desired to retain in the liquid and thereby discourage a substance from being carried up and forming a part of the froth; pH regulators, e.g., lime and soda ash, to produce optimum metallurgical results; and the like.

The phenomena which renders flotation a particularly valuable industrial operation appear to be largely associated with selective affinity of the surface of particulated solids, suspended in a liquid containing entrapped gas, for the liquid on the one hand, the gas on the other. The specific additives used in a flotation operation are selected according to the nature of the ore, the mineral sought to be recovered and the other additives which are to be used in combination therewith.

Flotation is employed in a number of mineral separation processes including the selective separation of such metal-containing sulfide minerals such as those containing copper, zinc, lead, nickel, molybdenum and other metals from iron-containing sulfide minerals such as pyrite or pyrrhotite.

Once recovered, the metal-containing minerals are converted to the more useful pure metal state, often by a smelting process. Such smelting processes can result in the formation of volatile sulfur compounds. These volatile sulfur compounds are often released to the atmosphere through smokestacks, or are removed from such smokestacks by expensive and elaborate scrubbing equipment.

Among collectors commonly used for the recovery of metal-containing sulfide minerals or sulfidized metal-containing oxide minerals are xanthates, dithiophosphates and thionocarbamates. Unfortunately, these materials are not particularly selective in the recovery of sulfide or sulfidized oxide minerals. For example, many nonferrous metal-containing sulfide minerals are found naturally in ore which also consists of iron-containing sulfide minerals when the iron-containing sulfide minerals are recovered in flotation processes along with the nonferrous metal-containing sulfide minerals and sulfidized metal-containing oxide minerals, there is excess sulfur present which is released in the smelting processes resulting in an undesirably high amount of sulfur present during the smelting operations. The xanthates, thionocarbamates and dithiophosphates do not selectively recover nonferrous metal-containing sulfide minerals in the presence of iron-containing sulfide minerals. On the contrary, such collectors collect and recover all metal-containing sulfide minerals.

Other collectors commonly recognized as useful in the recovery of sulfide-containing metal or sulfidized metal oxide values are mercaptans, disulfides (R—S-S—R) and polysulfides ($R—(S)_n—R$), wherein n is 3 or greater. Unfortunately, the mercaptan collectors have an environmentally undesirable odor, and are very slow kinetically in the flotation of metal sulfides. The disulfides and polysulfides, when used as collectors, give low recoveries with slow kinetics. Furthermore, the mercaptans, disulfides and polysulfides do not selectively recover nonferrous metal sulfides in the presence of ferrous sulfides.

In view of the foregoing, a composition which is useful for the recovery, at relatively good recovery rates and selectivity, of a broad range of metal-containing minerals from mineral ores, including metal-containing sulfide minerals, sulfidized metal-containing oxide minerals and metal-containing oxide minerals is desired.

SUMMARY OF THE INVENTION

Accordingly, in one aspect, the present invention is a composition comprising (a) a compound corresponding to the formula:

$$R^1—X—R—_nQ \qquad (I)$$

where $—R—_n$ is $$(—\overset{\overset{O}{\|}}{C}—)_y(—\overset{\overset{(R')_2}{|}}{C}—)_p(—\overset{\overset{H}{|}}{\underset{\underset{OH}{|}}{C}}—)_m$$

where

R′ is a hydrogen, methyl or ethyl, y+p+m=n, n is an integer from 1 to 6, y, p and m are independently 0 or an integer from 1 to 6 and each moiety can occur in random sequence; $R^1$ is a $C_{1-22}$ hydrocarbyl or a $C_{1-22}$-substituted hydrocarbyl; X is —S—, —O—, $$—\overset{\overset{R^3}{|}}{N}—,\ —\overset{\overset{O}{\|}}{C}—S—,\ —\overset{\overset{O}{\|}}{C}—\overset{\overset{R^3}{|}}{N}—,\ \text{or}\ —\overset{\overset{O}{\|}}{C}O—;$$

$R^3$ is hydrogen, a $C_{1-22}$ hydrocarbyl or a $C_{1-22}$ substituted hydrocarbyl; and Q is:

—$N(R^2)_a(H)_b$ where a+b equals 2 and $R^2$ is a $C_{1-22}$ hydrocarbyl or $C_{1-22}$ substituted hydrocarbyl, —N=Y where Y is S, O, a hydrocarbylene radical or a substituted hydrocarbylene radical, C≡N, or —N cyclic ring where the cyclic ring is saturated or unsaturated and may contain additional heteroatoms such as oxygen or sulfur or additional nitrogen atoms; and (b) an organic compound containing at least 4 carbon atoms and one or more monosulfide units.

The invention, in another aspect, is a method for recovering metal-containing minerals from a mineral ore which comprises subjecting the ore, in the form of an aqueous pulp, to a froth flotation process in the presence of the described composition under conditions such that the metal-containing minerals are selectively recovered in the froth.

The collector compositions of this invention are capable of floating a broad range of metal-containing mineral values including metal-containing sulfide minerals, metal-containing oxide minerals, sulfidized metal-containing oxide minerals and precious metals from ores by froth flotation. The collector compositions also provide higher recoveries and selectivity towards the desired minerals than can be achieved using either collector component alone, particularly in the recovery of nonferrous metal-containing minerals and a higher selectivity toward such nonferrous metal-containing minerals when such metal-containing minerals are found in the presence of iron-containing sulfide minerals.

In a preferred method of the present invention, the described collector composition is employed in a method for recovering metal-containing sulfide or sulfidized metal-containing oxide minerals from an ore which method comprises subjecting the ore, in the form of an aqueous pulp, to a froth flotation process in the presence of a flotating amount of the collector composition at conditions sufficient to cause the metal-containing sulfide or sulfidized metal-containing oxide particles to be driven to the air/bubble interface and recovered in the froth.

The collector composition and method of this invention result in a high recovery of nonferrous metal-containing minerals and a surprisingly high selectivity toward such nonferrous metal-containing and sulfidized metal-containing oxides when such metal-containing minerals are found in the presence of iron-containing sulfide minerals.

DETAILED DESCRIPTION OF THE INVENTION

Component (a) of the composition of this invention is a component having a structural formula (I). Although not specifically set forth in formula (I), in aqueous medium of less pH, component (a) can exist in the form of a salt. In this formula, $—R—_n$ is advantageously $—CH_2—_p$, $$\left(\underset{\underset{OH}{|}}{\overset{\overset{H}{|}}{C}}\right)_m, \left(\overset{\overset{O}{\|}}{C}\right)_y$$

or mixtures thereof, preferably $—CH_2—_p$ or $$\left(\underset{\underset{OH}{|}}{\overset{\overset{H}{|}}{C}}\right)_m$$

or mixture thereof, more preferably $—CH_2—_p$, wherein p+m+y=n and n is an integer from 1 to 6, preferably from 1 to 4, most preferably 2 or 3. $R^1$ and each $R^2$ is advantageously a $C_{1-22}$ hydrocarbyl or a $C_{1-22}$ hydrocarbyl substituted with one or more hydroxy, amino, phosphonyl, alkoxy, imino, carbamyl, carbonyl, thiocarbonyl, cyano, halo, ether, carboxyl, hydrocarbylthio, hydrocarbyloxy, hydrocarbylamino or hydrocarbylimino groups. If substituted, $R^1$ and $R^2$ are advantageously substituted with one or more hydroxy, carbonyl, amino, phosphonyl or alkoxy moieties. Q is preferably $—N(R^2)_a(H)_b$ wherein a+b=2, preferably a being 0 or 1 and b being 1 or 2.

More advantageously, the carbon atoms in $R^1$ and $R^2$ total 6 or more with $R^1$ preferably being a $C_{2-14}$ hydrocarbyl or a hydrocarbyl substituted with one or more hydroxy, amino, phosphonyl or alkoxy groups, more preferably a $C_{4-11}$ hydrocarbyl; and $R^2$ preferably being a $C_{1-6}$ alkyl or $C_{1-6}$ alkylcarbonyl or a $C_{1-6}$-substituted alkyl or alkylcarbonyl, more preferably a $C_{1-4}$ alkyl or $C_{1-4}$ alkylcarbonyl or a $C_{1-6}$ alkyl or $C_{1-6}$ alkylcarbonyl substituted with an amino, hydroxy or phosphonyl group, and most preferably a $C_{1-2}$ alkyl or $C_{1-2}$ alkylcarbonyl. X is preferably —S—, $$—\overset{\overset{R^3}{|}}{N}—,$$

or —O—, more preferably —S— or $$—\overset{\overset{R^3}{|}}{N}—,$$

most preferably —S—; and $R^3$ is preferably hydrogen or $C_{1-14}$ hydrocarbyl, more preferably hydrogen or $C_{1-11}$ hydrocarbyl, most preferably hydrogen.

As described, the component (a) includes compounds such as the S-(omega-aminoalkyl)hydrocarbon thioates:

$$R^1—\overset{\overset{O}{\|}}{C}—S\left(CH_2\right)_n\underset{\underset{(H)_b}{|}}{N}\left(R^2\right)_a; \quad \text{(II)}$$

the omega-(hydrocarbylthio)alkylamines:

$$R^1—S\left(CH_2\right)_n\underset{\underset{(H)_b}{|}}{N}\left(R^2\right)_a \quad \text{(III)}$$

which includes the omega-(hydrocarbylthio)alkylamides ($R^2$ is an alkyl carbonyl group, e.g., $$-\overset{O}{\overset{\|}{C}}-CH_3);$$

the N-(hydrocarbyl)-alpha,omega-alkanediamines:

$$R^1-\underset{\underset{R^3}{|}}{N}-(CH_2)_n-\underset{\underset{(H)_b}{|}}{N}-(R^2)_a; \quad \text{(IV)}$$

the N-(omega-aminoalkyl)hydrocarbon amides:

$$R^1-\overset{O}{\overset{\|}{C}}-\underset{\underset{R^3}{|}}{N}-(CH_2)_n-\underset{\underset{(H)_a}{|}}{N}-(R^2)_b; \quad \text{(V)}$$

the omega-(hydrocarbyloxy)alkylamines:

$$R^1-O-(CH_2)_n-\underset{\underset{(H)_b}{|}}{N}-(R^2)_a; \quad \text{(VI)}$$

and the omega-aminoalkyl hydrocarbonoates:

$$R^1-\overset{O}{\overset{\|}{C}}O-(CH_2)_n-\underset{\underset{(H)_b}{|}}{N}-(R^2)_a; \quad \text{(VII)}$$

wherein $R^1$, $R^2$, $R^3$, a, b and n are as hereinbefore defined. In formulas II-VII, when X is —S— or $$-\overset{O}{\overset{\|}{C}}-S-,$$

$R^1$ is preferably a $C_{4-10}$ hydrocarbyl; when X is $$-\underset{\underset{R^3}{|}}{N}- \text{ or } -\overset{O}{\overset{\|}{C}}-\overset{R^3}{\overset{|}{N}}-,$$

the total carbon content of the groups $R^1$ and $R^3$ is preferably between about 1 and about 23, more preferably about 2 and about 16, and most preferably about 4 and about 15; and when X is $$-\overset{O}{\overset{\|}{C}}O-$$

or —O—, $R^1$ is most preferably $C_{6-11}$ hydrocarbyl.

Of the foregoing, the preferred component (a) compounds are the omega-(hydrocarbylthio)alkylamine, N-(hydrocarbyl)-alpha,omega-alkanediamine, N-(omega-aminoalkyl)hydrocarbon amides, omega-(hydrocarbyloxy)alkylamine or a mixture thereof. More preferred collectors include omega-(hydrocarbylthio)alkylamines, N-(hydrocarbyl)alpha,omega-alkanediamines, N-(omega-aminoalkyl)hydrocarbon amides or mixtures thereof. The most preferred class of collectors are the omega-(hydrocarbylthio)alkylamines, particularly the omega-(hydrocarbylthio)alkylamides.

The omega-(hydrocarbylthio)alkylamines can be prepared by the processes disclosed in Berazosky et al., U.S. Pat. No. 4,086,273 (incorporated herein by reference); French Pat. No. 1,519,829 (incorporated herein by reference); and *Beilstein*, 4, 4th Ed., 4th Supp., 1655 (1979) (incorporated herein by reference). The N-(omega-aminoalkyl)hydrocarbon amides can be prepared by the processes described in Fazio, U.S. Pat. No. 4,326,067 (relevant parts incorporated herein by reference); *Acta Polon Pharm*, 19, 277 (1962) (incorporated herein by reference); and *Beilstein*, 4, 4th Ed., 3rd Supp., 587 (1962) (incorporated herein by reference). The omega-(hydrocarbyloxy)alkylamines can be prepared by the processes described in British Pat. No. 869,409 (relevant parts incorporated herein by reference); and Hobbs, U.S. Pat. No. 3,397,238 (incorporated herein by reference). The S-(omega-aminoalkyl)hydrocarbon thioates can be prepared by the processes described in Faye et al., U.S. Pat. No. 3,328,442 (incorporated herein by reference); and *Beilstein*, 4, 4th Ed., 4th Supp., 1657 (1979) (incorporated herein by reference). The omega-aminoalkyl hydrocarbonoates can be prepared by the process described in *J. Am. Chem. Soc.*, 83, 4835 (1961) (incorporated herein by reference); *Beilstein*, 4, 4th Ed., 4th Supp., 1413 (1979) (incorporated herein by reference); and *Beilstein*, 4, 4th Ed., 4th Supp., 1785 (1979) (incorporated herein by reference). The N-(hydrocarbyl)-alpha,omega-alkanediamines can be prepared by the process well-known in the art. One example is the process described in East German Pat. No. 98,510 (incorporated herein by reference).

Component (b) of the collector composition is an organic compound which contains at least 4 carbon atoms and one or more monosulfide units. Most preferably, the sulfur atoms of the monosulfide units are bound to non-aromatic carbon atoms, i.e., aliphatic or cycloaliphatic carbon atoms. The organic compounds can contain one or more monosulfide units.

Preferred organic compounds containing monosulfide units include those corresponding to the formula $$R^5-S-R^6 \quad \text{(VIII)}$$

wherein $R^5$ and $R^6$ are independently hydrocarbyl or substituted hydrocarbyl group; with the proviso that S is directly bound to only aliphatic or cycloaliphatic carbon atoms and $R^5$ and $R^6$ may combine to form a heterocyclic ring structure with S. The total carbon content of the organic compound is preferably such that the compound has sufficient hydrophobic character to cause metal-containing sulfide mineral particles to be driven to the air/bubble interface. If substituted, $R^5$ and $R^6$ are preferably substituted with one or more hydroxy, cyano, halo, ether, epoxy, hydrocarbyloxy or hydrocarbyl thioether moieties.

In general, $R^5$ and $R^6$ are advantageously independently unsubstituted aliphatic, cycloaliphatic or aralkyl; or aliphatic, cycloaliphatic or aralkyl substituted with one or more hydroxy, cyano, halo, —$OR^7$ or —$SR^7$ group(s) wherein $R^7$ is a hydrocarbyl radical, preferably aliphatic or cycloaliphatic, more preferably alkyl, alkenyl, cycloalkyl or cycloalkenyl, or $R^5$ and $R^6$ form a heterocyclic ring with the sulfur atom. $R^5$ and $R^6$ are more preferably an unsubstituted aliphatic or cycloaliphatic group or an aliphatic or cycloaliphatic group substituted with a hydroxy, —$OR^7$ or —$SR^7$ moiety. In a preferred embodiment, $R^5$ and $R^6$ are alkyl, alkenyl or cycloalkyl, unsubstituted or substituted with one or more hydroxy, —$OR^7$ or —$SR^7$ moieties. In a most preferred embodiment, $R^5$ and $R^6$ are not the same hydrocarbon moiety, that is, the monosulfide is asymmetrical with $R^5$ preferably being methyl or ethyl and $R^6$ preferably being a $C_{5-11}$ alkyl or alkenyl group.

Included within the definition of formula (I) are sulfide collectors having the structural formula:

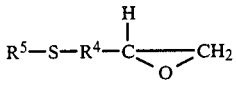

(Ia)

and $$R^5—S—R^6—S—R^5 \quad \text{(IIa)}$$

wherein $R^5$ and $R^6$ are as hereinbefore defined, each $R^5$ in formula (IIa) is the same or different and $R^4$ is a hydrocarbyl. Preferably, $R^4$ is a $C_{1-10}$ aliphatic or cyclic aliphatic group, more preferably a $C_{1-10}$ alkyl or alkenyl group.

Examples of cyclic compounds which can be employed as the organic sulfide compound include the following structures:

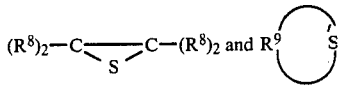

wherein each $R^8$ is independently hydrogen, a hydrocarbyl or substituted hydrocarbyl provided at least one $R^8$ is not hydrogen; and $R^9$ is an unsubstituted aliphatic group or aliphatic group substituted with a hydroxy, cyano, —$OR^7$ or —$SR^7$ group provided the sum of carbon atoms in the compound is at least 4. Preferably, each $R^8$ is independently hydrogen, a $C_{1-12}$ aliphatic or cycloaliphatic, more preferably hydrogen or a $C_{1-8}$ alkyl or alkenyl, most preferably a $C_{1-8}$ alkyl group; with at least two $R^8$'s being hydrogen.

The total carbon content of the organic sulfide most advantageously employed herein is dependent on a variety of factors including the component (a) employed, the specific ore being treated and the like. In general, to provide the required hydrophobic character to the organic sulfide, the organic sulfide compound contains at least 4, more preferably 6, and most preferably 8, carbon atoms. The maximum number of carbon atoms in the organic sulfide compound is preferably 24, more preferably 16, and most preferably 12.

Of the foregoing, preferred compounds useful as component (b) in this invention correspond to the formula:

$$(R^{10})_{3-y}C(H)_y—S—C(H)_y(R^{10})_{3-y},$$

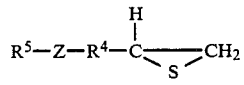

or

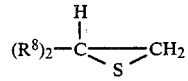

wherein $R^5$, $R^8$ and $R^4$ are as hereinbefore defined, each $R^{10}$ is independently hydrocarbyl, a hydrocarbyl substituted with a hydroxy, cyano, halo, —$OR^7$ or —$SR^7$, each y is independently an integer of 0, 1, 2 or 3, and —Z is —O— or —S—.

In the foregoing formula, $R^{10}$ is preferably an unsubstituted aliphatic, cycloaliphatic, aryl, alkaryl or aralkyl group, or an aliphatic, cycloaliphatic, aryl, aralkyl or alkaryl group substituted with a cyano, hydroxy, halo, —$OR^7$ or —$SR^7$ group, wherein $R^7$ is as hereinbefore defined. More preferably, $R^{10}$ is an unsubstituted aliphatic or cycloaliphatic group, or an aliphatic or cycloaliphatic substituted with a hydroxy, cyano, halo, aliphatic ether, cycloaliphatic ether, aliphatic thioether or cycloaliphatic thioether group. Even more preferably, $R^{10}$ is an alkyl, alkenyl, cycloalkyl or cycloalkenyl moiety. Preferably, each n is independently 1, 2 or 3, and more preferably one n is 2 or 3 and the other n is 2. Most preferably, one —$C(H)_y(R^{10})_{3-y}$ is a methyl or ethyl, and the other is a $C_{5-11}$ alkyl or alkenyl.

Examples of compounds within the scope of this invention include methylbutyl sulfide, methylpentyl sulfide, methylhexyl sulfide, methylheptyl sulfide, methyloctyl sulfide, methylnonyl sulfide, methyldecyl sulfide, methylundecyl sulfide, methyldodecyl sulfide, methylcyclopentyl sulfide, methylcyclohexyl sulfide, methylcycloheptyl sulfide, methylcyclooctyl sulfide, ethylbutyl sulfide, ethylpentyl sulfide, ethylhexyl sulfide, ethylheptyl sulfide, ethyloctyl sulfide, ethylnonyl sulfide, ethyldecyl sulfide, ethylundecyl sulfide, ethyldodecyl sulfide, ethylcyclopentyl sulfide, ethylcyclohexyl sulfide, ethylcycloheptyl sulfide, ethylcyclooctyl sulfide, propylbutyl sulfide, propylpentyl sulfide, propylhexyl sulfide, propylheptyl sulfide, propyloctyl sulfide, propylnonyl sulfide, propyldecyl sulfide, propylundecyl sulfide, propyldodecyl sulfide, propylcyclopentyl sulfide, propylcyclohexyl sulfide, propylcycloheptyl sulfide, propylcyclooctyl sulfide, dibutyl sulfide, butylpentyl sulfide, butylhexyl sulfide, butylheptyl sulfide, butyloctyl sulfide, butylnonyl sulfide, butyldecyl sulfide, butylundecyl sulfide, butyldodecyl sulfide, butylcyclopentyl sulfide, butylcyclohexyl sulfide, butylcycloheptyl sulfide, butylcyclooctyl sulfide, dipentyl sulfide, pentylhexyl sulfide, pentylheptyl sulfide, pentyloctyl sulfide, pentylnonyl sulfide, pentyldecyl sulfide, pentylundecyl sulfide, pentyldodecyl sulfide, pentylcyclopentyl sulfide, pentylcyclohexyl sulfide, pentylcycloheptyl sulfide, pentylcyclooctyl sulfide, dihexyl sulfide, hexylheptyl sulfide, hexyloctyl sulfide, hexylnonyl sulfide, hexyldecyl sulfide, hexylundecyl sulfide, hexyldodecyl sulfide, hexylcyclopentyl sulfide, hexylcyclohexyl sulfide, hexylcycloheptyl sulfide, hexylcyclooctyl sulfide, diheptyl sulfide, heptyloctyl sulfide, heptylnonyl sulfide, heptyldecyl sulfide, heptylundecyl sulfide, heptyldodecyl sulfide, heptylcyclopentyl sulfide, heptylcyclohexyl sulfide, heptylcycloheptyl sulfide, heptylcyclooctyl sulfide, dioctyl sulfide, octylnonyl sulfide, octyldecyl sulfide, octylundecyl sulfide, octyldodecyl sulfide, octylcyclopentyl sulfide, octylcyclohexyl sulfide, octylcycloheptyl sulfide, octylcyclooctyl sulfide, octylcyclodecyl sulfide, dinonyl sulfide, nonyldecyl sulfide, nonylundecyl sulfide, nonyldodecyl sulfide, nonylcyclopentyl sulfide, nonylcyclohexyl sulfide, nonylcycloheptyl sulfide, nonylcyclooctyl sulfide, didecyl sulfide, decylundecyl sulfide, decyldodecyl sulfide, decylcyclopentyl sulfide, decylcyclohexyl sulfide, decylcycloheptyl sulfide, and decylcyclooctyl sulfide. More preferred sulfides include methylhexyl sulfide, methylheptyl sulfide, methyloctyl sulfide, methylnonyl sulfide, methyldecyl sulfide, ethylhexyl sulfide, ethylheptyl sulfide, ethyloctyl sulfide, ethylnonyl sulfide, ethyldecyl sulfide, dibutyl sulfide, dipentyl sulfide, dihexyl sulfide, diheptyl sulfide, and dioctyl sulfide.

The composition of the present invention is prepared using sufficient amounts of component (a) and component (b) to prepare an effective collector for mineral values in a froth flotation process. The amounts of each component most advantageously employed in preparing the composition will vary depending on the specific components (a) and (b) employed, the specific ore being treated and the desired rates of recovery and selectivity. The composition preferably comprises from about 10 to about 90, more preferably from 20 to 90, percent by weight, of component (a), and from about 10 to about 90, more preferably from 10 to 80, percent by weight, of component (b). The composition of this invention even more preferably comprises from about 30 to about 80 percent by weight of component (a) and from about 20 to about 70 percent by weight of component (b). Within these compositional limitations, the amount of components (a) and (b) are selected such that the recovery of the desired metal-containing mineral in a froth flotation process is higher than either component could recover at the same weight dosage.

The method of this invention is useful for the recovery by froth flotation of metal-containing minerals from ores. An ore refers herein to the metal as it is taken out of the ground and includes the metal-containing minerals in admixture with the gangue. Gangue refers herein to those materials which are of little or no value and need to be separated from the metal values. This process can be used to recover metal-containing oxide minerals, metal-containing sulfide minerals, sulfidized metal-containing oxide minerals and other metal values. Of the various minerals which can be recovered, those which have high natural hydrophobicity in the unoxidized state are preferred. The term "hydrophobicity in the unoxidized state" applies to a freshly ground mineral or a mineral having a fresh surface which demonstrates a tendency to float without collector addition.

Ores for which the composition and method of the present invention are useful include sulfide mineral ores containing copper, zinc, molybdenum, cobalt, nickel, lead, arsenic, silver, chromium, gold, platinum, uranium or mixtures thereof. Examples of metal-containing sulfide minerals which may be concentrated by froth flotation using the composition and method of this invention include copper-bearing minerals such as covellite ($CuS$), chalcocite ($Cu_2S$), chalcopyrite ($CuFeS_2$), valleriite ($Cu_2Fe_4S_7$ or $Cu_3Fe_4S_7$), bornite ($Cu_5FeS_4$), cubanite ($Cu_2SFe_4S_5$), enargite ($Cu_3(As_1Sb)S_4$), tetrahedrite ($Cu_3SbS_2$), tennantite ($Cu_{12}As_4S_{13}$), brochantite ($Cu_4(OH)_6SO_4$), antlerite ($Cu_3SO_4(OH)_4$), famatinite ($Cu_3(SbAs)S_4$), and bournonite ($PbCuSbS_3$); lead-bearing minerals such as galena ($PbS$); antimony-bearing minerals such as stibnite ($Sb_2S_3$); zinc-bearing minerals such as sphalerite ($ZnS$); silver-bearing minerals such as stephanite ($Ag_5SbS_4$) and argentite ($Ag_2S$); chromium-bearing minerals such as daubreelite ($FeSCrS_3$); nickel-bearing minerals such as pentlandite [$(FeNi)_9S_8$]; molybdenum-bearing minerals such as molybdenite ($MoS_2$); and platinum- and palladium-bearing minerals such as cooperite ($Pt(AsS)_2$). Preferred metal-containing sulfide minerals include molybdenite ($MoS_2$), chalcopyrite ($CuFeS$), galena ($PbS$), sphalerite ($ZnS$), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics, so the minerals can be recovered in froth flotation using collectors which recover sulfide minerals. Sulfidization results in oxide minerals having sulfide characteristics. Oxide minerals are sulfidized by contact with compounds which react with the minerals to form a sulfur bond or affinity. Such methods are well-known in the art. Such compounds include sodium hydrosulfide, sulfuric acid and related salts such as sodium sulfide.

Sulfidized metal-containing oxide minerals and metal-containing oxide minerals for which this process is useful include oxide minerals containing copper, aluminum, iron, titanium, magnesium, chromium, tungsten, molybdenum, manganese, tin, uranium or mixtures thereof. Examples of metal-containing oxide minerals which may be concentrated by froth flotation using the process of this invention include copper-bearing minerals such as cuprite ($Cu_2O$), tenorite ($CuO$), malachite ($Cu_2(OH)_2CO_3$), azurite ($Cu_3(OH)_2(CO_3)_2$), atacamite ($Cu_2Cl(OH)_3$), chrysocolla ($CuSiO_3$); aluminum-bearing minerals such as corundum; zinc-containing minerals such as zincite ($ZnO$) and smithsonite ($ZnCO_3$); tungsten-bearing minerals such as wolframite [$(Fe, Mn)WO_4$]; nickel-bearing minerals such as bunsenite ($NiO$); molybdenum-bearing minerals such as wulfenite ($PbMoO_4$) and powellite ($CaMoO_4$); iron-containing minerals such as hematite and magnetite; chromium-containing minerals such as chromite ($FeOCr_2O_3$); iron- and titanium-containing minerals such as ilmenite; magnesium- and aluminum-containing minerals such as spinel; titanium-containing minerals such as rutile; manganese-containing minerals such as pyrolusite; tin-containing minerals such as cassiterite; and uranium-containing minerals such as uraninite, gummite ($UO_3nH_2O$) and pitchblende [$U_2O_5(U_3O_8)$].

Other metal values for which this process is useful include gold-bearing minerals such as sylvanite ($AuAgTe_2$) and calaverite ($AuTe$); platinum- and palladium-bearing minerals such as sperrylite ($PtAs_2$); and silver-bearing minerals such as hessite ($AgTe_2$). Also included are metals which occur in a metallic state, e.g., gold, silver and copper.

The collector composition of this invention is preferably employed in the recovery, in a froth flotation process, of sulfide minerals or sulfidized oxide minerals containing copper, nickel, lead, zinc, or molybdenum, most preferably copper.

The collector composition of this invention can be used in any concentration which gives the desired recovery of the desired mineral(s). In particular, the concentration used is dependent upon the particular mineral(s) being recovered, the grade of the ore to be subjected to the froth flotation process and the desired quality of the mineral(s) recovered. Preferably, the collector composition of this invention is used in a concentration of 5 grams (g) to 1000 g per metric ton of ore, more preferably between about 10 g and 200 g of collector per metric ton of ore to be subjected to froth flotation. In general, to obtain optimum synergistic behavior, it is most advantageous to begin at low dosage levels and increase the levels until the desired effect is achieved.

During the froth flotation process of this invention, the use of frothers is preferred. Frothers are well-known in the art and reference is made thereto for the purposes of this invention. Any frother which results in the recovery of the desired metal value is suitable. Frothers useful in this invention include any frothers known in the art which give the recovery of the desired mineral value. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates, and the like. Furthermore, blends of such frothers may also be used. All frothers which are suitable for beneficiation of mineral ores by froth flotation can be used in this invention.

In addition, in the process of this invention it is contemplated that the collector combination which makes up the composition of this invention can be used in mixtures with other collectors well-known in the art.

The collector composition of this invention may also be used with an amount of other collectors known in the art, sufficient to give the desired recovery of mineral value. Examples of such other collectors useful in this invention include dialkyl thioureas, alkyl, dialkyl and trialkyl thiocarbonates, alkyl and dialkyl thionocarbamates, alkyl dithiophosphates; diaryl dithiophosphates, thiophosphonyl chlorides, dialkyl and diaryl dithiophosphonates, alkyl mercaptans, xanthogen formates, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, guanidine, and alkyl propylene diamines.

The following examples are included for the purposes of illustration only and are not to be construed to limit the scope of the invention or claims. Unless otherwise indicated, all parts and percentages are by weight.

In the examples, the performance of the frothing processes described is shown by giving the fractional amount of recovery at the specified time.

EXAMPLE 1

A series of bags (Sample Nos. 1–8) containing 1200 g of homogeneous copper/molybdenum ore, containing chalcopyrite and molybdenite minerals, from Western Canada are prepared. The ore in each bag is ground using 800 ml of tap water for 14 minutes in a ball mill having a mixed ball charge to produce approximately a 13 percent plus 100 mesh grind. The resulting pulp is transferred to an Agitair 1500-ml flotation cell outfitted with an automated paddle, removal system. The pH of each slurry is adjusted to 10.2 using lime. No further pH adjustments are made during the test. A standard methyl isobutyl carbinol (MIBC) frother and the collectors or collector combinations set forth in Table I are employed to float the copper and molybdenum using a four-stage rougher floation scheme as set forth below.

| | | |
|---|---|---|
| STAGE 1: | Collector | 0.0042 kg/metric ton* |
| | MIBC | 0.015 kg/metric ton** |
| | | condition - 1 minute |
| | | float - collect concentrate for 1 minute |
| STAGE 2: | Collector | 0.0021 kg/metric ton* |
| | MIBC | 0.005 kg/metric ton** |
| | | condition - 0.5 minute |
| | | float - collect concentrate for 1.5 minutes |
| STAGE 3: | Collector | 0.0016 kg/metric ton* |
| | MIBC | 0.005 kg/metric ton** |
| | | condition - 0.5 minute |
| | | float - collect concentrate for 2.0 minutes |
| STAGE 4: | Collector | 0.0033 kg/metric ton* |
| | MIBC | 0.005 kg/metric ton** |
| | | condition - 0.5 minute |
| | | float - collect concentrate for 2.5 minutes |

*kilogram of the collector or collector composition per metric ton of ore being treated

**kilogram of the frother per metric ton of ore being treated

The results of the froth flotation testing are complied in Table I.

TABLE I

| Sample No. | Collector[1] | Cu R-7[2] | Moly R-7[2] | Cu Grade[3] | Moly Grade[3] |
|---|---|---|---|---|---|
| 1* | F-1 | 0.688 | 0.682 | 0.063 | 0.00233 |
| 2* | F-2 | 0.770 | 0.713 | 0.028 | 0.00125 |
| 3* | S-1 | 0.710 | 0.691 | 0.093 | 0.00325 |
| 4* | S-2 | 0.699 | 0.697 | 0.107 | 0.00386 |
| 5 | S-1/F-1 | 0.766 | 0.768 | 0.052 | 0.00157 |
| 6 | S-1/F-2 | 0.732 | 0.750 | 0.081 | 0.00275 |
| 7 | S-2/F-1 | 0.759 | 0.764 | 0.050 | 0.00170 |
| 8 | S-2/F-2 | 0.743 | 0.755 | 0.091 | 0.00316 |

*Not an example of the present invention

[1]F-1 = $C_6H_{13}S(CH_2)_2NH_2$

F-2 = $C_6H_{13}S(CH_2)_2N(H)(CC_2H_5)=O$

S-1 = $C_6H_{13}-C(H)(S)-CH_2$

S-2 = $C_6H_{13}-S-CH_3$

[2]R-7 is the fractional recovery after 7 minutes

[3]Grade is the fractional content of specified metal in total weight collected in the froth In conducting the froth flotation testing on Sample Nos. 5–8, the collector composition comprises 50 weight percent of each collector.

As evidenced by the data set forth in Table I, the composition of the present invention which comprises a collector combination, results in superior recovery in the froth flotation process as compared to a froth flotation process using a single collector.

EXAMPLE 2

A copper/nickel ore from Eastern Canada is divided into a series of 900 g samples. The ore contains chalcopyrite, pentlandite, and pyrrhotite minerals. All tests are performed using an Agitair 1500 ml cell operated at a speed of 900 rpm with an air flow of 9.0 liters/minute. Before flotation, each sample is ground in a rod mill for 1080 revolutions. Before grinding, 600 ml of water are added along with sufficient lime to adjust the slurry pH to 9.2. After grinding, the ore has a particle size of less than 200 mesh (75 microns). The rod mill contents are emptied into the float cell and a the pH adjusted to 9.2 (using either lime or sulfuric acid).

A complex nine-stage flotation sequence is performed. The first four stages are referred to as rougher float and stages five through nine as scavenger float. After stage 4, sulfuric acid is added to adjust the pH to 9.2; $CuSO_4$ is added to stage 5 and stage 7 (0.015 kg/metric ton). DOW-FROTH 250 (a trademark of The Dow Chemical Company) is employed as the frother.

The addition rates of frother and collector were as shown in Table IIA.

TABLE IIA

| Stage | Dosage Collector (kg/metric ton) | Condition Time (min) | Dosage DOWFROTH® 250 (kg/metric ton) | Flotation Time (min) |
|---|---|---|---|---|
| 1 | 0.028 | 1.0 | 0.012 | 1 |
| 2 | 0.012 | 0.5 | — | 2 |
| 3 | 0.008 | 0.5 | — | 2 |
| 4 | 0.004 | 0.5 | 0.004 | 2 |
| 5 | 0.012 | 0.5 | 0.003 | 2 |
| 6 | 0.006 | 0.5 | 0.004 | 2 |
| 7 | 0.007 | 0.5 | 0.002 | 2 |
| 8 | 0.006 | 0.5 | 0.001 | 2 |
| 9 | 0.007 | 0.5 | 0.001 | 2 |

The samples are dried, weighed and metal assays performed. Standard mass balance formulae are used to calculate recoveries and grades. The results are compiled in Table IIB.

TABLE IIB

| Run No. | Collector | Cu R-7[2] | Cu R-17[3] | Ni R-7[2] | Ni R-17[3] | Pyrrhotite R-7[2] |
|---|---|---|---|---|---|---|
| 1[1] | A | 0.969 | 0.980 | 0.730 | 0.948 | 0.398 |
| 2[1] | B | 0.958 | 0.971 | 0.533 | 0.710 | 0.258 |
| 3[4] | A + B | 0.963 | 0.978 | 0.670 | 0.931 | 0.331 |

A - $C_6H_{13}S(CH_2)_2NHC\overset{O}{\overset{\|}{C}}_2H_5$
B - $C_4H_9SC_4H_9$
[1]Not an example of this invention.
[2]R-7 is the fractional recovery after 7 minutes.
[3]R-17 is the fractional recovery after 17 minutes.
[4]In Run 3, the collector is 50/50 weight percent of each collector.

In this example, the lowest pyrrhotite recovery and highest Cu and Ni recoveries possible after 7 minutes are important, as it is at this time point that the major rejection of high sulfur-containing mineral occurs. At 17 minutes the Cu and Ni recoveries are to be the highest possible using normal flotation logic. However, Cu recoveries were approaching the theoretical limit of 1.0 at both 7 and 17 minutes, so statistically significant comparisons were not possible.

Clearly, the recovery of Ni at 7 minutes using a collector blend of this invention gives a high value with low pyrrhotite. Also, the Ni recovery at 17 minutes with the blend of this invention is high.

EXAMPLE 3

A series of uniform 1000-g samples of a complex Pb/Zn/Cu/Ag ore from Central Canada are prepared. The ore contained galena, sphalerite, chalcopyrite and argentite minerals. For each flotation run, a sample is added to a rod mill along with 500 ml of tap water and 7.5 milliliters of $SO_2$ solution. Six and one-half minutes of mill time are used to prepare the feed such that 90 percent of the ore has a particle size of less than 200 mesh (75 microns). After grinding, the contents are transferred to a cell fitted with an automated paddle for froth removal, and the cell attached to a standard Denver flotation mechanism.

A two-stage flotation is then performed—Stage I being a copper/lead/silver rougher and Stage II being a zinc rougher. To start the Stage I flotation, 1.5 g/kg of $Na_2CO_3$ is added (pH of 9 to 9.5), followed by the addition of the collector(s). The pulp is then conditioned for 5 minutes with air and agitation. This is followed by a 2-minute condition period with agitation only. A methyl isobutyl carbinol frother is then added (standard dose of 0.015 ml/kg). The concentrate is collected for 8 minutes of flotation and labeled as copper/lead rougher concentrate.

The Stage II flotation consists of adding 0.5 kg/metric ton of $CuSO_4$ to the cell remains of Stage I. The pH is then adjusted to 10.5 with lime addition. This is followed by a condition period of 5 minutes with agitation only. The pH is then rechecked and adjusted back to 10.5 with lime. At this point, the collector(s) are added, followed by a five-minute condition period with agitation only. A methyl isobutyl carbinol frother is then added (standard dose of 0.020 ml/kg). Concentrate is collected for 8 minutes and labeled as zinc rougher concentrate.

The concentrate samples are dried, weighed, and appropriate samples prepared for assay using X-ray techniques. Using the assay data, fractional recoveries and grades are calculated using standard mass balance formulae. The results are compiled in Table III.

TABLE III

| Run No. | Stage (Rougher) | Collector | Dosage (kg/t) | pH | Ag R-5 | Cu R-5 | Pb R-5 | Zn R-5 |
|---|---|---|---|---|---|---|---|---|
| 1* | Cu/Pb | A | 0.0125 | 9.5 | 0.871 | 0.936 | 0.748 | 0.234 |
| | Zn | A | 0.035 | 10.5 | 0.067 | 0.031 | 0.114 | 0.741 |
| 2 | Cu/Pb | A + B | 0.005 + 0.0045 | 9.5 | 0.883 | 0.944 | 0.800 | 0.277 |
| | Zn | A + B | 0.020 + 0.009 | 10.5 | 0.057 | 0.032 | 0.082 | 0.711 |
| 3 | Cu/Pb | A + C | 0.005 + 0.0075 | 9.5 | 0.890 | 0.945 | 0.774 | 0.268 |
| | Zn | A + C | 0.020 + 0.015 | 10.5 | 0.060 | 0.032 | 0.108 | 0.717 |
| 4* | Cu/Pb | A | 0.0121 | 9.5 | 0.839 | 0.930 | 0.728 | 0.251 |
| | Zn | B | 0.021 | 10.5 | 0.082 | 0.042 | 0.139 | 0.736 |

*Not an example of this invention.
A - dihexylsulfide
B - 2-(hexylthio)ethylamine
C - ethyl 2-(hexylthio)ethylamide
R-5 is the actual recovery after 5 minutes As evidenced by the results set forth in Table III, the recovery of silver, copper and lead are effectively enhanced during Stage I of the flotation operation when using the collector composition of the present invention (i.e., A+B or A+C) as compared to employing a single collector during Stage I (Runs 1 and 4 represent the test where only a single component is used in each stage).

Specifically, in Stage I of Run 2, the addition of the two-component blend of this invention at less dosage as compared to the single component collector of Stage I of Run 1, gave slightly more Ag and Cu recovery and significantly more Pb recovery.

In a similar manner, the collector blends of this invention in Stage I of Run 3 compared to Stage I of either Run 1 or 4, gave higher Ag recovery, slightly higher Cu recovery, and much higher Pb recovery. Note that Ag, Cu or Pb not recovered in Stage I is lost to the process.

In the Stage II flotation, the recovery of zinc remains acceptable using the collector composition of this invention. In view of this performance, it is more advantageous to use the collector combination of the present invention in the described recovery process.

What is claimed is:

1. A composition comprising (a) a compound corresponding to the formula:

$$R^1—X—(R)_n—N(R^2)_a(H)_b$$

where $—(R)_n—$ is

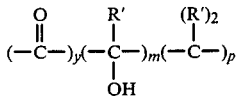

R′ is hydrogen, methyl or ethyl, y+p+m=n, n is an integer from 1 to 6, y and m are independently 0 or 1, y+m=0 or 1, p is an integer from 1 to 6 and each moiety can occur in random sequence; $R^1$ and $R^2$ are independently a $C_{1-22}$ hydrocarbyl or a $C_{1-22}$ substituted hydrocarbyl; X is —S— or

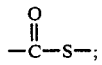

a is 0 or 1, b is 1 or 2 and a+b=2; and (b) an organic compound containing at least 4 carbon atoms and one or more monosulfide units.

2. The composition of claim 1 wherein the organic sulfide compound is a compound of the formula:

$$R^5—S—R^6$$

wherein $R^5$ and $R^6$ are independently a hydrocarbyl group; a hydrocarbyl group substituted with one or more hydroxy, cyano, halo, ether, hydrocarbyloxy or hydrocarbyl thioether moieties; or a heterocyclic ring structure with S, with the proviso that S is directly bound to only aliphatic or cycloaliphatic carbon atoms.

3. The composition of claim 2 wherein $R^1$ and $R^2$ are independently a $C_{1-22}$ hydrocarbyl or a $C_{1-22}$ hydrocarbyl substituted with one or more hydroxy, amino, phosphonyl, alkoxy, imino, carbamyl, carbonyl, thiocarbonyl, cyano, halo, ether, carboxyl, hydrocarbylthio, hydrocarbyloxy, hydrocarbylamino or hydrocarbylimino groups and each R is independently

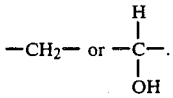

4. The composition of claim 3 wherein y=0, m=0 and p is an integer from 1 to 6; $R^1$ is a $C_{2-14}$ hydrocarbyl or a $C_{2-14}$ hydrocarbyl substituted with one or more hydroxy, amino, phosphonyl or alkoxy groups; $R^2$ is a $C_{1-6}$ alkyl, $C_{1-6}$ alkylcarbonyl, or a $C_{1-6}$ alkyl or $C_{1-6}$ alkylcarbonyl group substituted with an amino, hydroxy or phosphonyl group.

5. The composition of claim 4 wherein p is 2 or 3.

6. The composition of claim 3 wherein $R^5$ and $R^6$ are independently hydrocarbyl, hydrocarbyl substituted with one or more hydroxy, cyano, halo, ether, epoxy, $—OR^7$ or $—SR^7$ wherein $R^7$ is a hydrocarbyl radical and $R^5$ and $R^6$ may combine to form a heterocyclic ring with S.

7. The composition of claim 6 wherein $R^5$ and $R^6$ are independently unsubstituted aliphatic, cycloaliphatic or aralkyl; or aliphatic, cycloaliphatic or aralkyl substituted with one or more hydroxy, $—OR^7$ or $—SR^7$ groups and $R^7$ is aliphatic or cycloaliphatic.

8. The composition of claim 7 wherein the total carbon content of the sulfide compound is from about 4 to about 24 carbon atoms.

9. The composition of claim 8 wherein $R^5$ and $R^6$ are independently aliphatic or cycloaliphatic groups unsubstituted or substituted with one or more hydroxy, $OR^7$ or $SR^7$ groups.

10. The composition of claim 4 which comprises from about 10 to about 90 percent by weight of component (a) and from about 10 to about 90 percent by weight of component (b) wherein the sulfide compound corresponds to one of the formulae

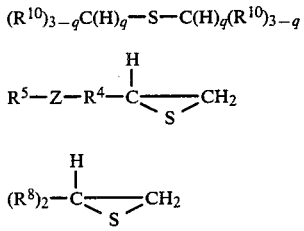

wherein each $R^{10}$ is independently hydrocarbyl or hydrocarbyl substituted with a hydroxy, cyano, halo, ether, $—OR^7$ or $—SR^7$; q is an integer of 0, 1, 2 or 3; Z is oxygen or sulfur; $R^5$ is an aliphatic or cycloaliphatic, unsubstituted or substituted with a hydroxy, $—OR^7$ or $—SR^7$, $R^4$ is a $C_{1-10}$ aliphatic or cycloaliphatic group; and each $R^8$ is independently hydrogen or $C_{1-12}$ aliphatic or cycloaliphatic group, provided one $R^8$ is not hydrogen.

11. The composition of claim 10 which comprises from about 20 to about 90 percent by weight of component (a) and from about 10 to about 80 percent by weight of component (b).

12. The composition of claim 11 wherein R is $—CH_2—$; $R^1$ is $C_{2-14}$ hydrocarbyl; $R^2$ is $C_{1-6}$ alkyl or $C_{1-6}$ alkylcarbonyl; $R^5$ and $R^6$ are independently an alkyl, alkenyl or cycloalkyl group and the sum of carbon atoms in $R^5$ and $R^6$ is from 6 to about 16; and p is an integer of 1 to 4.

13. The composition of claim 10 wherein $R^1$ is $C_{4-11}$ hydrocarbyl; $R^2$ is $C_{1-4}$ alkyl or $C_{1-4}$ alkylcarbonyl; $R^5$ is $C_{1-2}$ alkyl; $R^6$ is a $C_{5-11}$ alkyl or alkenyl group; X is —S—; or —O—; and p is the integer 2 or 3.

14. The composition of claim 1 wherein component (a) is 2-(hexylthio)ethylamine or ethyl 2-(hexylthio)ethylamide.

15. The composition of claim 1 wherein component (b) is ethyl octyl sulfide.

16. A method of recovering a metal-containing mineral from an ore which comprises subjecting the ore, in the form of an aqueous pulp, to a froth flotation process in the presence of a flotating amount of the flotation collector composition of claim 1.

17. The method of claim 16 wherein component (b) is a sulfide of the formula $R^5—S—R^6$, wherein $R^5$ and $R^6$ are independently a hydrocarbyl group, a hydrocarbyl group substituted with one or more hydroxy, cyano, halo, ether, hydrocarbyloxy or hydrocarbylthio groups; or a heterocyclic ring structure with S; with the proviso that S is directly bound to aliphatic or cycloaliphatic carbon atoms.

18. The method of claim 17 wherein the collector comprises from about 10 to about 90 percent by weight of component (a) and from about 10 to about 90 percent by weight of component (b) wherein the sulfide compound corresponds to one of the formulae $$(R^{10})_{3-q}C(H)_q—S—C(H)_q(R^{10})_{3-q}$$

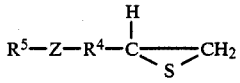

-continued

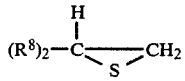

wherein each $R^{10}$ is independently hydrocarbyl or hydrocarbyl substituted with a hydroxy, cyano, halo, ether, $—OR^7$ or $—SR^7$; q is an integer of 0, 1, 2 or 3; Z is oxygen or sulfur; $R^5$ is an aliphatic or cycloaliphatic, unsubstituted or substituted with a hydroxy, $—OR^7$ or $—SR^7$, $R^4$ is a $C_{1-10}$ aliphatic or cycloaliphatic group; and each $R^8$ is independently hydrogen or $C_{1-12}$ aliphatic or cycloaliphatic group, provided one $R^8$ is not hydrogen.

19. The method of claim 18 wherein the collector comprises from about 20 to about 90 percent by weight of component (a) and from about 10 to about 80 percent by weight of component (b).

20. The method of claim 17 wherein the metal-containing mineral recovered in the froth contains copper, zinc, molybdenum, cobalt, nickel, lead, arsenic, silver, chromium, gold, platinum, uranium, or mixture thereof.

21. The method of claim 20 wherein the metal-containing mineral is a metal-containing sulfide mineral.

22. The method of claim 21 wherein the metal-containing sulfide mineral contains copper, nickel, lead, zinc or molybdenum.

23. The method of claim 20 wherein the collector composition is present in a concentration of from about 0.001 kg of collector/ton to about 1.0 kg of collector/ton of feed to flotation.

* * * * *

UNITED STATES PATENT AND TRADEMARK OFFICE

CERTIFICATE OF CORRECTION

PATENT NO. : 4,676,890

DATED : June 30, 1987

INVENTOR(S) : Richard R. Klimpel and Robert D. Hansen

It is certified that error appears in the above-identified patent and that said Letters Patent is hereby corrected as shown below:

In [57], under "ABSTRACT", line 11, "omega-(hydrocarbyloxy)-alkalamine" should read -- omega-(hydrocarbyloxy)alkylamine --.

Col. 2, line 48, "$R^1$-X-R-$_n$Q" should read --$R^1$-X$\{R\}_n$Q --.

Col. 2, line 51, "-R-$_n$" should read -- $\{R\}_n$ --.

Col. 3, line 10, "-N cyclic" should read -- -N cyclic --.

Col. 3, line 67, "-R-$_n$" should read -- $\{R\}_n$.--.

Col. 3, lines 67 and 68, "-$CH_2$-$_p$" should read -- $\{CH_2\}_p$ --.

Col. 4, line 7, "-$CH_2$-$_p$" should read -- $\{CH_2\}_p$ --.

Col. 4, line 14, "-$CH_2$-$_p$" should read -- $\{CH_2\}_p$ --.

Col. 11, line 53, "floation" should read -- flotation --.

Col. 12, line 27, that portion of the formula reading F-2 = $c_6$ should read -- F-2 = $C_6$ --.

Col. 12, line 29, that portion of the formula reading S-1 = $c_6$ should read -- S-1 = $C_6$ --.

Col. 12, line 31, that portion of the formula reading S-2 = $c_6$ should read -- S-2 = $C_6$ --.

UNITED STATES PATENT AND TRADEMARK OFFICE

CERTIFICATE OF CORRECTION

PATENT NO. : 4,676,890

DATED : June 30, 1987

INVENTOR(S) : Richard R. Klimpel and Robert D. Hansen

It is certified that error appears in the above-identified patent and that said Letters Patent is hereby corrected as shown below:

Col. 16, Claim 13, line 65, delete "or -0-;".

Signed and Sealed this

Nineteenth Day of July, 1988

*Attest:*

DONALD J. QUIGG

*Attesting Officer*

*Commissioner of Patents and Trademarks*